US009599952B2

(12) United States Patent
Fujinaka et al.

(10) Patent No.: US 9,599,952 B2
(45) Date of Patent: Mar. 21, 2017

(54) IMAGE FORMING APPARATUS

(71) Applicant: CANON KABUSHIKI KAISHA, Tokyo (JP)

(72) Inventors: Hiromi Fujinaka, Chofu (JP); Takuya Suto, Kawasaki (JP); Yuichiro Osawa, Kamakura (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/697,700

(22) Filed: Apr. 28, 2015

(65) Prior Publication Data

US 2015/0331385 A1 Nov. 19, 2015

(30) Foreign Application Priority Data

May 14, 2014 (JP) ..... 2014-100398
Apr. 14, 2015 (JP) ..... 2015-082319

(51) Int. Cl.
*G03G 15/00* (2006.01)
*G03G 21/16* (2006.01)

(52) U.S. Cl.
CPC ..... *G03G 21/1609* (2013.01); *G03G 21/1633* (2013.01); *G03G 15/6502* (2013.01);
(Continued)

(58) Field of Classification Search
CPC ..... G03G 15/0863; G03G 15/0872; G03G 15/0886; G03G 15/0879; G03G 2215/0668; G03G 2215/0695; G03G 15/5004; G03G 15/80; G03G 15/0126; G03G 15/346; G03G 21/12; G03G 21/1676; G03G 15/0121
See application file for complete search history.

(56) References Cited

U.S. PATENT DOCUMENTS 7,758,040 B2 7/2010 Hashimoto et al.
8,145,096 B2 3/2012 Kawanami et al.
(Continued)

FOREIGN PATENT DOCUMENTS

JP 2008-162721 A 7/2008
JP 2009-128506 A 6/2009

OTHER PUBLICATIONS

Tomoya Kuruma et al., U.S. Appl. No. 14/571,854, filed Dec. 16, 2014.

(Continued)

*Primary Examiner* — Roy Y Yi
(74) *Attorney, Agent, or Firm* — Fitzpatrick, Cella, Harper & Scinto

(57) ABSTRACT

An image forming apparatus includes a main assembly provided with an opening and a tray for placing thereon a cartridge for forming an image, wherein the tray is movable through the opening between an image forming position where the cartridge is used for image formation inside the main assembly and a mounting and demounting position where the cartridge is exposed to an outside of the main assembly and is mountable and demountable. In addition a door opens and closes the opening, and an accommodating member accommodates a sheet on which an image is formed. When the tray is in the mounting and demounting position, the door supports the tray and the accommodating member supports the door.

20 Claims, 13 Drawing Sheets

(52) U.S. Cl.
CPC ..... *G03G 2221/1684* (2013.01); *G03G 2221/1869* (2013.01)

(56) References Cited

U.S. PATENT DOCUMENTS

| | | | | |
|---|---|---|---|---|
| 2007/0160380 | A1 | 7/2007 | Imaizumi et al. | |
| 2007/0160384 | A1* | 7/2007 | Sakurai ..... | G03G 21/1853 399/110 |
| 2007/0160386 | A1 | 7/2007 | Kawamura | |
| 2008/0219696 | A1* | 9/2008 | Itabashi ..... | G03G 21/1671 399/114 |
| 2009/0129812 | A1 | 5/2009 | Kawanami et al. | |
| 2010/0080614 | A1* | 4/2010 | Yamaguchi ..... | G03G 21/1853 399/111 |
| 2010/0080617 | A1 | 4/2010 | Noguchi | |
| 2010/0080618 | A1* | 4/2010 | Suzuki ..... | G03G 21/1853 399/112 |
| 2010/0098459 | A1 | 4/2010 | Hoashi | |
| 2014/0147158 | A1 | 5/2014 | Fujinaka et al. | |

OTHER PUBLICATIONS

European Search Report dated Oct. 14, 2015, in related European Patent Application No. 15165578.4.

* cited by examiner (a)

(b)

IMAGE FORMING APPARATUS

FIELD OF THE INVENTION AND RELATED ART

The present invention relates to an image forming apparatus for forming an image on a recording material (medium).

In a conventional image forming apparatus, when a plurality of process cartridges are provided and arranged in a horizontal direction on a movable tray (moving member: cartridge supporting member) and the tray is pulled out to an outside of an apparatus main assembly, the process cartridges are mountable to and demountable from the apparatus main assembly in some cases. In such an image forming apparatus, an openable cover covering an opening for permitting pulling-out of the tray from the apparatus main assembly is provided and in interrelation with opening and closing of the cover, interface members for an associated one of the cartridges are contacted to said spaced from the cartridge (Japanese Laid-Open Patent Application (JP-A) 2009-128506).

In a conventional example described in JP-A 2009-128506, a tray holding member is moved in a front-rear direction and an up-down direction in interrelation with rotation of a door. According to an embodiment thereof, along a closing operation of the door, first, the tray holding member is moved rearward and downward in the apparatus main assembly, and thereafter is further moved rearward. Then, with movement of the tray holding member, the interface members (such as a cartridge urging (pressing) member, a driving connection member and an energizing member) for the associated cartridge are contacted to the associated cartridge.

When the door is opened, the interface members are spaced from the associated cartridge in reverse order to the order when the door is closed, so that the cartridge can be easily exchanged (replaced) in a front access manner.

In an apparatus in JP-A 2009-128506, also in a state in which the tray is pulled out to an outside of the apparatus main assembly, there is a need to prevent damage of a drum surface caused by large downward flexure of the tray by self-weight of the tray and the cartridges in the front side of the apparatus main assembly. Alternatively, there is a need to prevent the apparatus main assembly from falling frontward due to out of weight balance caused by the pulling-out of the tray. For that reason, the tray in a position larger projected from the apparatus main assembly is supported by a supporting portion for a connecting arm for connecting the door and inner parts.

Further, as the conventional image forming apparatus, there is an image forming apparatus in which a sheet feeding cassette is extendable correspondingly to a size of a sheet used. In such an image forming apparatus, there is an image forming apparatus employing a constitution in which the sheet feeding cassette is projected from the main assembly of the image forming apparatus only in the case where the size of the sheet use is large (JP-A 2008-162721).

According to JP-A 2008-162721, also in the case where the sheet feeding cassette is downsized with downsizing of the image forming apparatus, it is possible to use the large-sized sheet by using the extendable sheet feeding cassette.

However, in JP-A 2009-128506, in order to support, by the connecting arm, the self-weight of the tray and the cartridges in the position largely projected from the apparatus main assembly, rigidity of the tray and the connecting arm is required. For that reason, in the case where downsizing of the apparatus main assembly is intended to be advanced, there is a liability that part sizes of the tray and the connecting arm are subjected to constraints. Further, in the case where a cartridge accommodating a toner in a large amount (volume) is used so that a frequency of exchange of the cartridge by a user can be reduced, there is a need to further enhance the rigidity of the tray and the connecting arm, and therefore there is a liability that the need prevents the downsizing of the apparatus main assembly.

Further, in JP-A 2008-162721, optimization of the sheet feeding cassette is not taken into consideration in combination with the tray, and therefore the above-described problem has not been used.

An image forming apparatus capable of simply supporting the self-weight of the tray and the cartridges in the position projected from the apparatus main assembly without enhancing the rigidity of the tray leading to upsizing of the apparatus main assembly has been required.

SUMMARY OF THE INVENTION

According to an aspect of the present invention, there is provided an image forming apparatus comprising: a main assembly provided with an opening; a tray for placing thereon a cartridge for forming an image, wherein the tray is movable through the opening between an image forming position where the cartridge is used for image formation inside the main assembly and a mounting and demounting position where the cartridge is exposed to an outside of the main assembly and is mountable and demountable; a door for opening and closing the opening; and an accommodating member for accommodating a recording material used for the image formation, wherein when the tray is in the mounting and demounting position, the door supports the tray and the accommodating member supports the door.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described with reference to the drawings.

First Embodiment

Image Forming Apparatus

Figure 1:
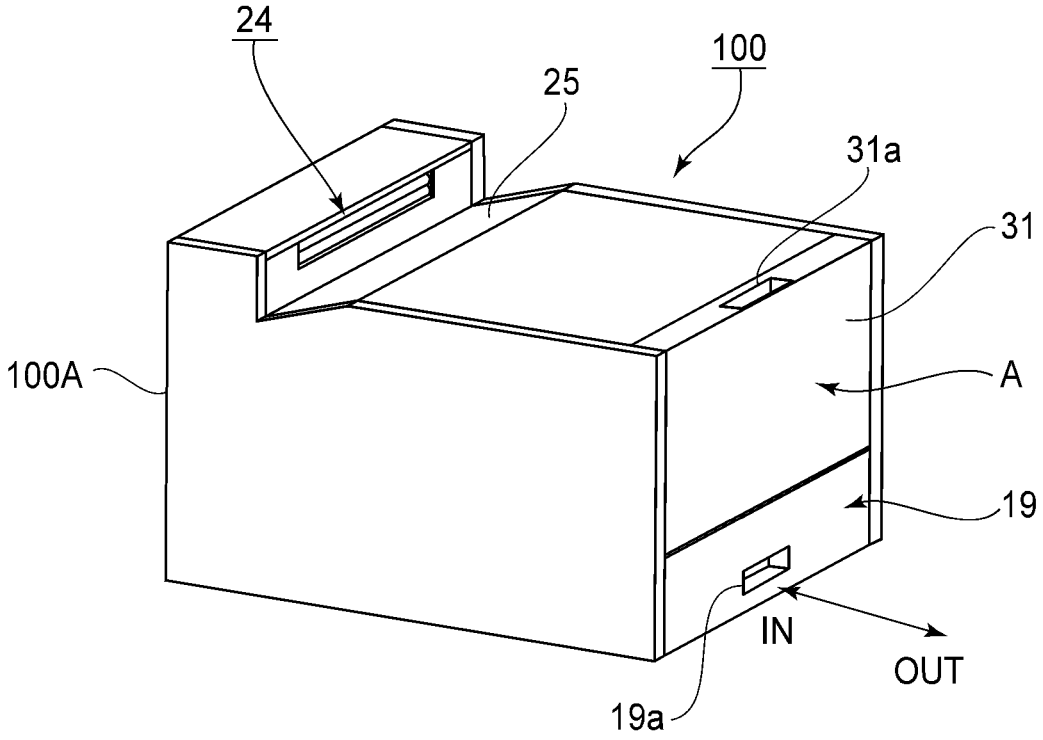
FIG. 1 is a perspective view of an outer appearance of an image forming apparatus in a First Embodiment of the present invention.
Figure 2:
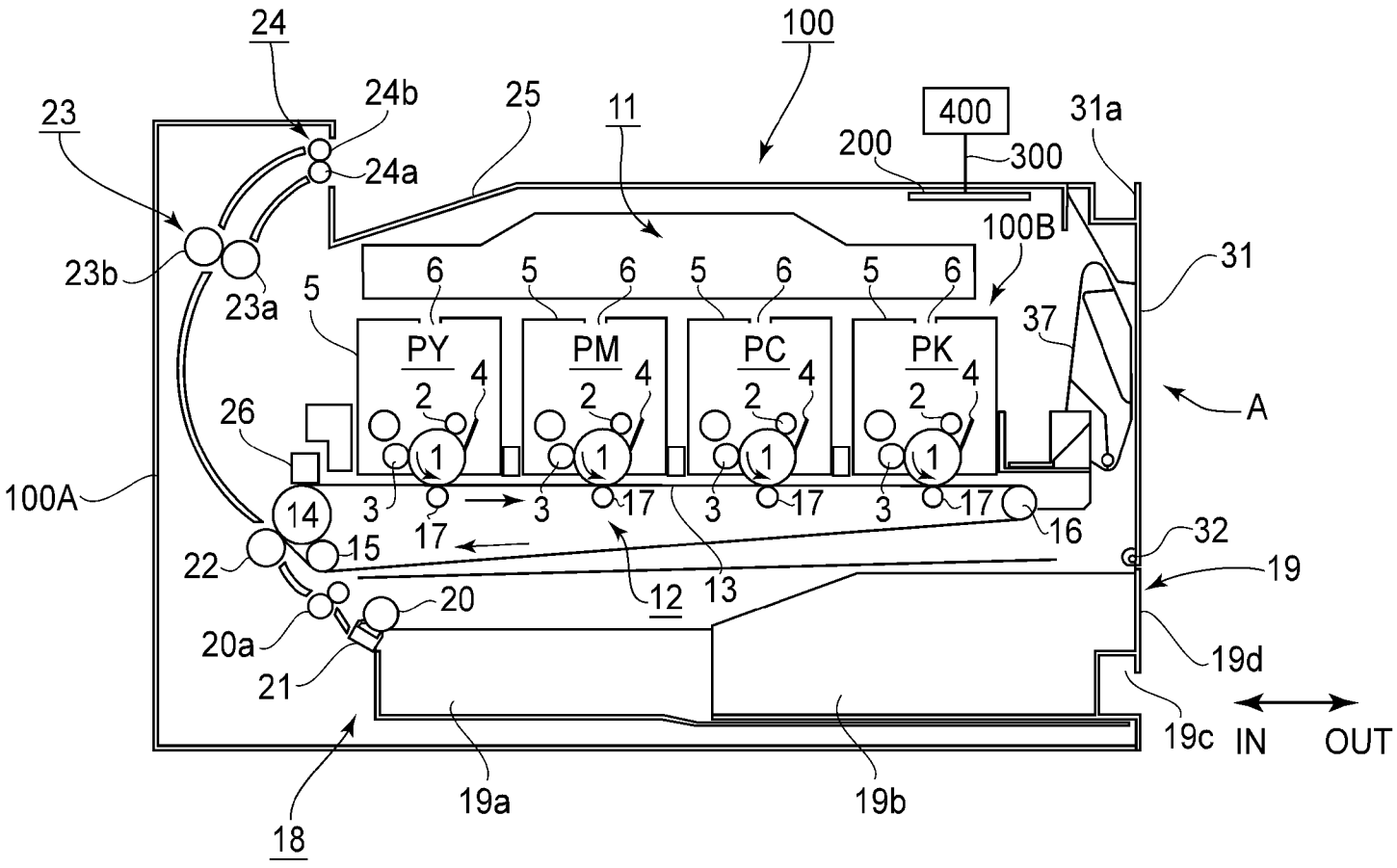
FIG. 2 is a longitudinal left side view of the image forming apparatus in the First Embodiment.

FIG. 1 is a perspective view of an outer appearance of an image forming apparatus 100, including a cartridge, in this embodiment of the present invention, and FIG. 2 is a longitudinal left side view of the image forming apparatus. In general, the image forming apparatus is an apparatus (device) which forms an image on a recording material by using well-known various image forming principles and methods (processes) such as an electrophotographic process, an electrostatic recording process and a magnetic recording process. The image forming apparatus includes a copying machine, a printer (an LED printer, a laser beam printer, or the like), a facsimile machine, an image display apparatus (electronic blackboard or electronic whiteboard) and the like. On the recording material, the image is formed by the image forming apparatus, and the recording material may include, e.g., paper (sheet), an OHT sheet, an image display material, and the like.

The cartridge is prepared by integrally assembling a part or all of an image forming portion, including an image bearing member on which the image is formed and including an image forming process means actable on the image bearing member, into a unit (cartridge). The cartridge contributes to the image forming process for forming the image on the recording material by being detachably mounted in an apparatus main assembly of the image forming apparatus. The apparatus main assembly is an image forming apparatus constituent portion obtained by removing the cartridge from the image forming apparatus of the cartridge type.

As the image bearing member, it is possible to use an electrophotographic photosensitive member in the electrophotographic process, an electrostatic recording dielectric member in the electrostatic recording process, a magnetic recording magnetic member in the magnetic recording process, and members capable of forming the image by other various image forming principles and methods. The image forming process means is a device which acts on the image bearing member to form the image.

The image forming apparatus 100 shown in FIG. 1 is specifically a four-color based full-color laser printer (electrophotographic image forming apparatus) which includes first to fourth (four) cartridges P (PY, PM, PC, PK) and which uses an electrophotographic process.

That is, the image forming apparatus 100 can form a four-color based full-color image or a monochromatic image on a sheet-like recording material S on the basis of an electrical image signal outputted from an external host device 400 and inputted into a controller 200 via an interface portion 300. The external host device 400 is a personal computer, an image reader, a remote facsimile machine or the like.

The controller 200 is a control means for controlling an electrophotographic image forming process and transfers various pieces of electrical information with the external host device 400. Further, the controller 200 effects processing of pieces of electrical information inputted from various process devices and sensors, processing of instruction signals to the various process devices, control of a predetermined initial sequence, a control of a sequence of a predetermined electrophotographic image forming process, and the like.

In the following description, with respect to the image forming apparatus 100, a front side (front surface side) means the side where an apparatus opening/closing door (main assembly portion) 31 is provided. A rear side (rear surface side) is the side opposite to the front side. A front-rear direction includes a direction (frontward direction) directed from the rear side toward the front side of the image forming apparatus 100 and a direction (rearward direction) opposite to the frontward direction. The left and right sides are the left and right sides when the image forming apparatus 100 is seen from the front side of the image forming apparatus 100. A left-right direction includes a leftward direction directed from right toward left when the image forming apparatus 100 is seen from the front side of the image forming apparatus 100 and a rightward direction opposite to the leftward direction. Upper and lower are those with respect to a direction of gravitation. An upward direction is a direction directed from below toward above, and a downward direction is a direction directed from above toward below.

Further, a longitudinal (long) direction is a direction parallel to a rotational axis direction of an electrophotographic photosensitive member which is an image bearing member on which a latent image is formed. A short direction is a direction (perpendicular direction) perpendicular to the longitudinal direction.

Inside an apparatus main assembly (main assembly frame) 100A of the image forming apparatus 100, a cartridge accommodating portion 100B is provided.

In the apparatus main assembly 100A, four (first to fourth) process cartridges P (PY, PM, PC and PK) are juxtaposed from the rear side to the front side (inline constitution, tandem type). Each of the mounting positions of the cartridges P is a position where the cartridge P is capable of performing an image forming operation in the cartridge accommodating portion 100B.

Each cartridge P contributes to an image forming process for forming the image on the recording material S, and is used by being detachably mounted in the apparatus main assembly 100A of the image forming apparatus 100.

Each cartridge P in this embodiment includes a drum-type electrophotographic photosensitive member (hereinafter referred to as a drum) 1 as the image bearing member on which the latent image is formed. The cartridge P further includes, as electrophotographic image forming process means actable on the drum 1, a charging means 2, a developing means 3 and a cleaning means 4, and is a so-called integral-type process cartridge.

In this embodiment, the charging means 2 is a contact charging roller. The developing means 3 is a developing device, of a contact type or a non-contact type, in which a developing roller 3*a* as a developer carrying member for developing the latent image by supplying a developer to the drum 1 and a developer accommodating portion 3*b* accommodating the developer, and the like are provided. The cleaning means 4 is a blade cleaning device including a cleaning blade as a cleaning member and a residual toner accommodating portion, and the like.

The respective cartridges P include a similar electrophotographic process mechanism provided with image forming process devices as described above, and accommodate developers (toners) different in color from each other.

That is, the developing device 3 of the first cartridge PY accommodates a yellow (Y) toner, and on the surface of the drum 1, a toner image of yellow (Y) is formed. The developing device 3 of the second cartridge PM accommodates a magenta (M) toner, and on the surface of the drum 1, a toner image of magenta (M) is formed.

The developing device 3 of the third cartridge PC accommodates a cyan (C) toner, and on the surface of the drum 1, a toner image of cyan (C) is formed. The developing device 3 of the fourth cartridge PK accommodates a black (K) toner, and on the surface of the drum 1, a toner image of black (K) is formed.

Above the cartridges PY, PM, PC and PK, a laser scanner unit 11 as an exposure device unit (exposure means) for forming the latent image by exposing the drum 1 of each cartridge to light is provided. This scanner unit 11 outputs laser light L modulated correspondingly to image information for each color inputted from the external host device 400 into the controller 200 to subject the surface of the drum 1 of each cartridge P to scanning exposure through an exposure window 6 provided at an upper surface of a cartridge frame 5.

Under the cartridges PY, PM, PC and PK, a transfer unit 12 as a transfer unit (transfer member), opposing the drums 1 of the cartridges P, onto which the toner images are primary-transferred and from which the toner images are secondary-transferred onto the recording material S is provided.

The unit 12 includes, as an intermediary transfer member (second image bearing member: intermediary recording medium), an endless belt (belt member, belt) 13 which is formed of a dielectric material and which has flexibility. Further, the unit 12 includes a driving roller 14, a turn roller 15 and a tension roller 16 around which the belt 13 is extended and stretched to be moved and circulated. The driving roller 14 and the turn roller 15 are disposed on the rear side of the apparatus main assembly 100A.

The tension roller 15 is disposed on the front side of the apparatus main assembly 100A. The drum 1 of each cartridge P contacts, at its lower surface, an upper surface of an upper belt portion of the belt 13 in a state in which the cartridges P are mounted in the predetermined mounting positions in the predetermined manner. Inside the belt 13, four primary transfer rollers 17 are provided opposed to the drums 1 of the cartridges P, respectively, through the upper belt portion of the belt 13.

In each cartridge P, a nip between the drum 1 and the belt 13 is a primary transfer nip. A secondary transfer roller 22 is contacted to the belt 13 toward the driving roller 14. A nip between the secondary transfer roller 22 and the belt 13 is a secondary transfer nip.

Below the intermediary transfer unit 12, a sheet feeding unit 18, which stacks the sheet-like recording material S onto which the toner images are transferred, for feeding the recording material S one by one to the intermediary transfer unit 12 is provided.

The sheet feeding unit 18 includes a sheet feeding cassette (accommodating member) 19, a sheet feeding roller 20, a separation pad 21, a registration roller pair 20*a* and the like. The sheet feeding cassette 19 can be freely moved into (inserted into) and moved away from (demounted from) the apparatus main assembly 100A in the front side (front loading). The sheet feeding cassette 19 is composed of a main container 19*a* and a SC 19*b*, and the SC 19*b* slides relative to the main container 19*a* and is extendably held by the main container 19*a*. A grip portion 19*c* is provided in a front plate 19*d* of the SC 19*b* of the sheet feeding cassette 19. An extension (expansion) and contraction MC for the main container 19*a* and the SC 19*b* will be described later. The sheet feeding cassette 19 is the accommodating member for accommodating paper.

At an upper rear portion inside the apparatus main assembly 100A, a fixing device 23 which is a fixing unit (fixing means) for fixing the transferred toner images on the recording material S under application of heat and pressure and a sheet discharging roller pair 24 for discharging the recording material S are provided.

An upper surface of the apparatus main assembly 100A is configured as a sheet discharge tray 25. The fixing device 23 includes a fixing film assembly 23*a* and a pressing roller 23*b*. The sheet discharging roller pair 24 includes sheet discharging rollers 24*a* and 24*b*.

(Cartridge Exchanging Method)

In each of the first to fourth cartridges PY, PM, PC and PK, with use thereof for image formation, the developer accommodated in the developing device 3 is consumed. Then, when the developer is consumed to such an extent that an image of a quality satisfactory to a user who has purchased the cartridge cannot be formed, the cartridge loses commercial value as the cartridge.

Therefore, e.g., the image forming apparatus is provided with a means (not shown) for detecting an amount of the developer remaining in individual cartridge. The detected remaining amount value is compared, by the controller 200, with a threshold (value) preset for providing a prewarning or warning of a lifetime of the cartridge. When the detected remaining amount value is smaller than the preset threshold, the prewarning or warning of the lifetime of the cartridge is displayed on a display portion (not shown). As a result, the image forming apparatus prompts the user to prepare a cartridge for exchange, or to replace the cartridge with a fresh cartridge, in order to maintain an output image quality.

1) Tray 35, Opening 30 and Main Assembly Door 31

In the image forming apparatus 100 in this embodiment, the exchange (replacement) of the cartridge P is performed through a method (pulling-out method) in which the cartridge P is placed on a tray (movable member) 35 for pulling out the cartridge P and then is replaced in a front-access manner in order to improve usability. Then, in the front side of the apparatus main assembly 100A, an opening 30 (also as an opening through which the cartridge P is inserted into the cartridge accommodating portion 100B of the apparatus main assembly 100A) for permitting passing therethrough the cartridge P in order to take out the cartridge P from the apparatus main assembly 100A is provided.

Further, a main assembly door (opening/closing member) 31 movable between a closed position A (FIGS. 1 and 2) where the opening 30 (FIG. 4) is closed and an open position B (FIGS. 3 and 4) where the opening 30 is open. That is, the main assembly door 31 is capable of taking the closed position where the opening 30 is closed and the open position where the opening 30 is open.

In this embodiment, the door 31 can be opened and closed and can be rotationally moved relative to the apparatus main assembly 100A about a horizontal (lateral) shaft (hinge shaft) 32 provided at a lower portion of the door 31.

Figure 3:
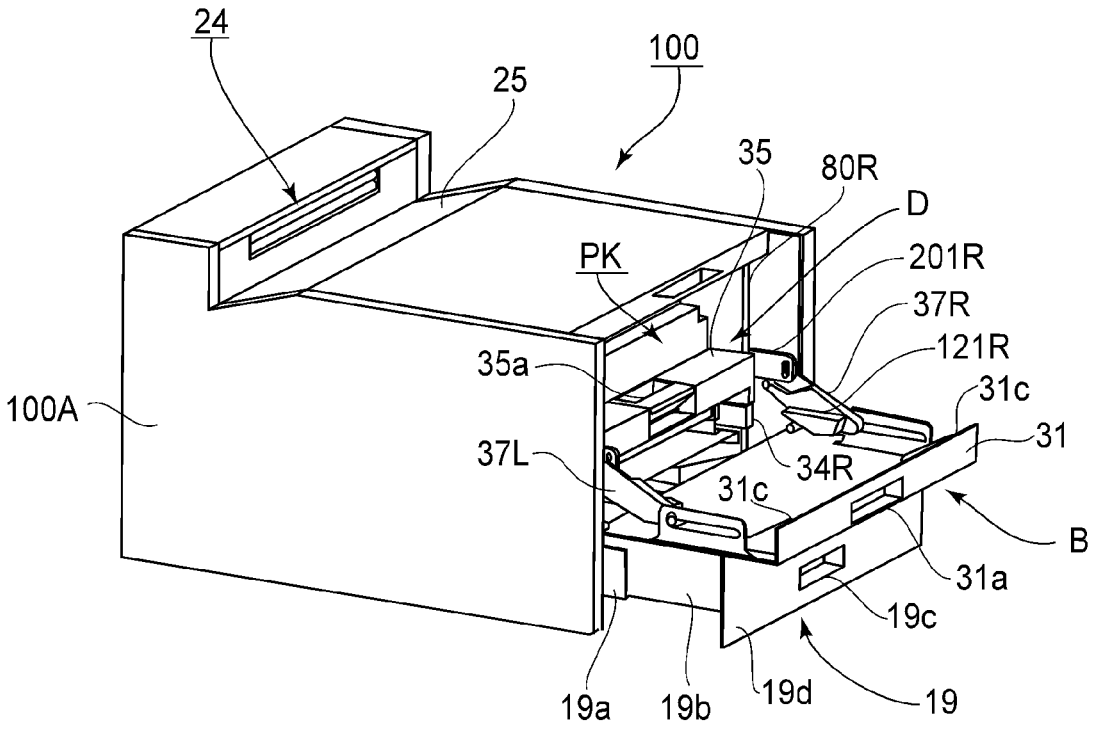
FIG. 3 is a perspective view of an outer appearance of the image forming apparatus in a state in which a recording material is stacked and a door is open.
Figure 4:
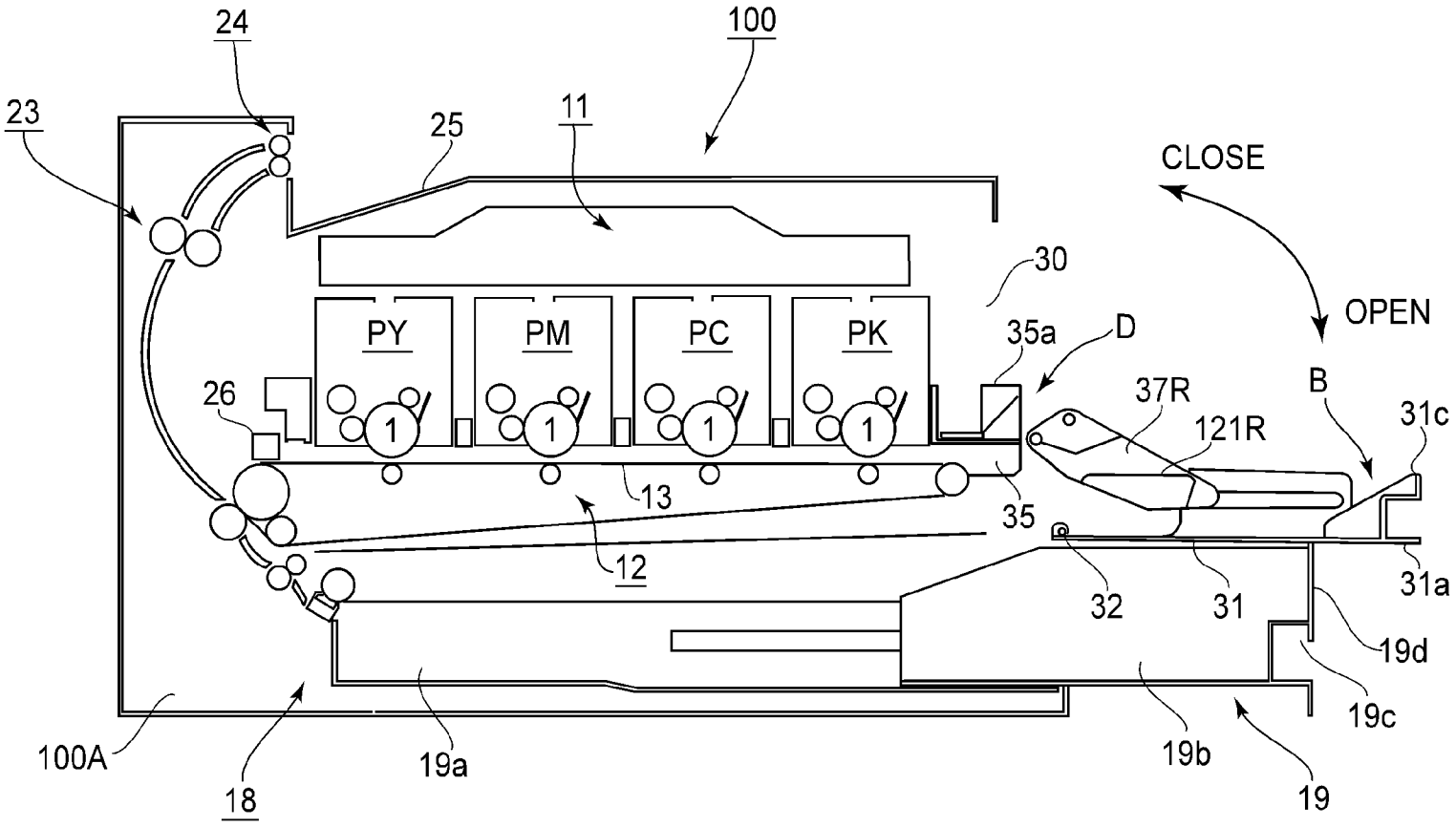
FIG. 4 is a longitudinal left side view of the image forming apparatus in the state in which the recording material is stacked and the door is open.

That is, the door 31 is rotated about the hinge shaft 32 in a raising direction, so that it can be placed in a closed state with respect to the apparatus main assembly 100 as shown in FIGS. 1 and 2. By closing the door 31, the opening 30 is closed. Further, the door 31 is rotated frontward substantially horizontally with respect to the apparatus main assembly 100*a* about the hinge shaft 32, so that it can be placed in an open state from the apparatus main assembly 100A as shown in FIGS. 3 and 4. As a result, the opening 30 at the front surface of the apparatus main assembly 100A is largely opened. In FIG. 1, a finger placement portion 31*a* for opening/closing the door 31 is provided to the door 31.

2) Tray 35

Figure 9:
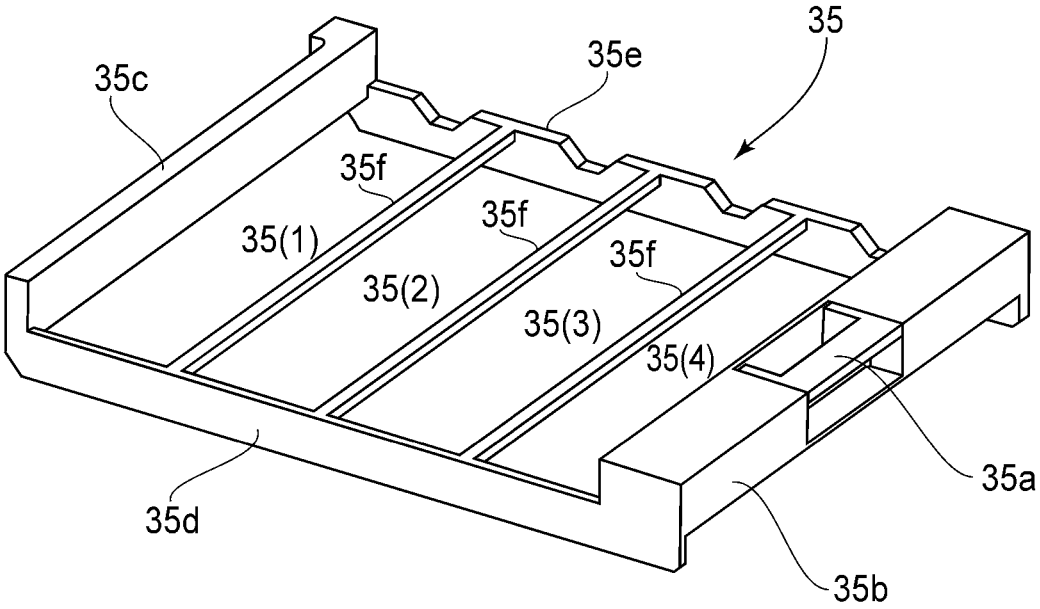
FIG. 9 is a perspective view of the tray in the First Embodiment.
Figure 10:
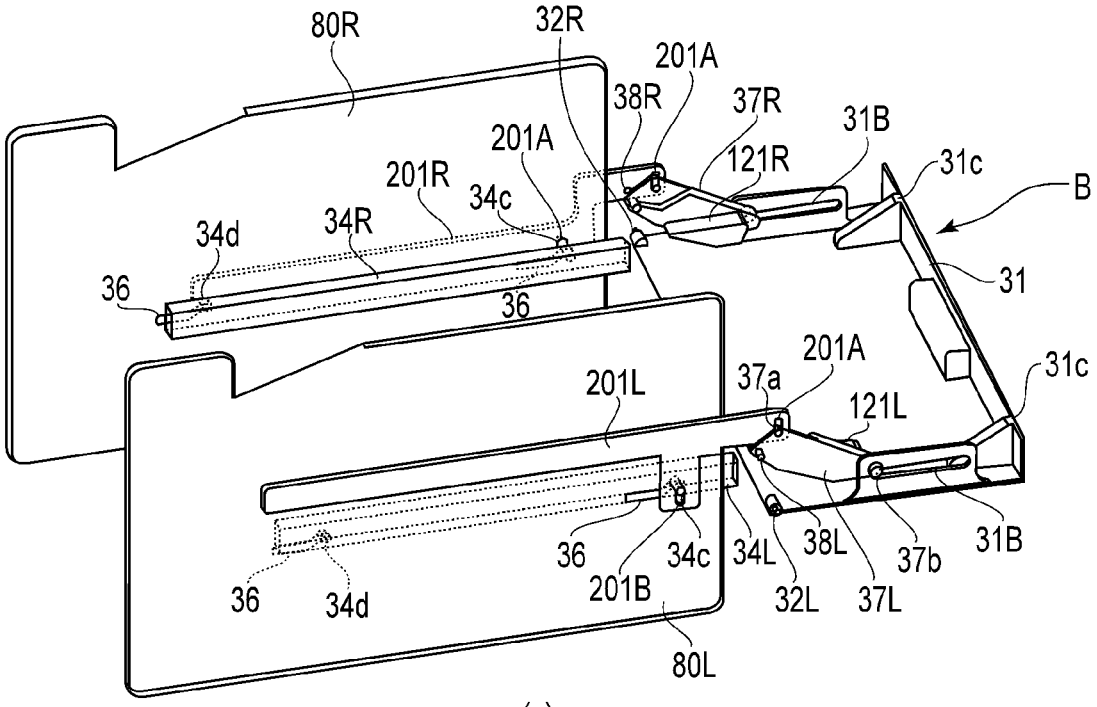
In FIG. 10, (a) and (b) are perspective views of an interrelating mechanism of the door and a tray holding member in the First Embodiment.
Figure 10:
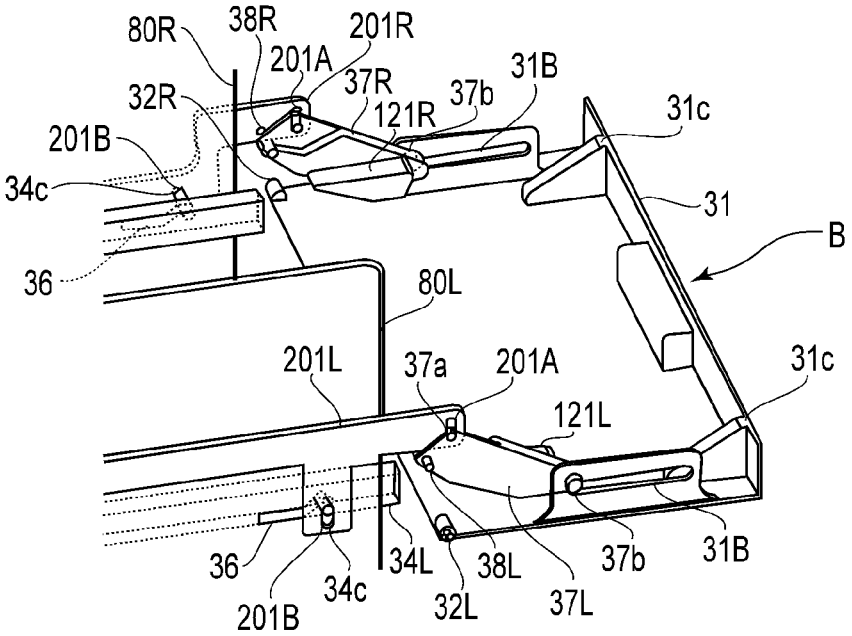

The tray 35 which holds the cartridges PY, PM, PC and PK and which is shown in FIG. 9 are a perspective view of an outer appearance thereof, and is slidably movable linearly and horizontally in a front-rear direction (horizontal direction with respect to a disposing surface of the apparatus main assembly 100A). That is, lower surfaces of left and right frames 35*d* and 35*e* of the tray 35 are placed on and supported by upper surfaces of left and right tray holding members 34L and 34R, respectively (FIG. 10). Further, the tray 35 is supported inside between left and right frames 80L and 80R, and slides on the upper surfaces of the tray holding members 34L and 34R, thus being slidably movable horizontally in the front-rear direction relative to the tray holding members 34L and 34R.

In FIG. 10, the left and right frames 80L and 80R are fixedly disposed as left and right side plates of a main frame (main assembly frame) as framework of the apparatus main assembly 100. On the other hand, the tray holding members 34L and 34R are displaceable in an obliquely upward direction or an obliquely downward direction as described later.

When the door 31 is in the closed position A as shown in FIGS. 1 and 2, the tray 35 is in an image forming position (AP) C where each of the cartridges P is located in a mounting position where the image forming operation can be performed. In this embodiment, the image forming position C of the tray 35 is a position where the drum 1 of each cartridge P and the belt 13 of the intermediary transfer unit 12 contact each other (FIG. 2).

As shown in FIG. 9, the tray 35 includes a rectangular large frame portion in which a space is partitioned into substantially equal four portions by three partition plates 35*f*, so that first to fourth elongated small frame portions 35(1) to 35 (4) are formed in this order from a rear frame 35*c* side to a front frame 35*b* side. The small frame portions 35(1) to 35(4) are portions for holding the first to fourth (four) cartridges PY, PM, PC and PK, respectively.

Each cartridge P is inserted into the associated small frame portion of the tray 35 from above, and lower surfaces of left and right side beam portions are received by upper surfaces of left and right frames 35*d* and 35*e*, respectively, so that the cartridge P is placed on and held by the tray 35. That is, the tray 35 supports each cartridge P so as to be demountable toward right above (upward). Further, each cartridge P is moved toward right below (downward), and then is held by the tray 35, so that the tray 35 roughly holds each cartridge P. By employing such a constitution, exchange of the cartridge P can be made easy.

Figure 14:
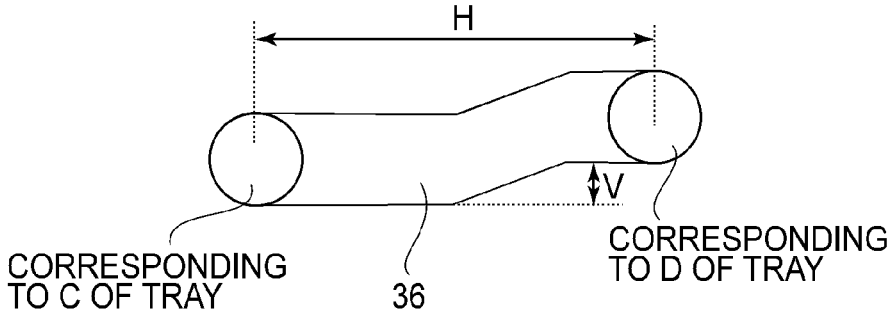
FIG. 14 is an illustration relating to a displacement between an image forming position and a movable position of the tray.

2-1) Displacement of Tray Between Image Forming Position C and Movable Position D In interrelation with the opening/closing (opening rotational movement) of the door 31, the tray holding members 34L and 34R move in an obliquely upward direction (frontward direction and upward direction) by a predetermined amount (FIGS. 10 and 14). As a result, the tray 35 supporting the cartridges PY, PM, PC and PK is displaced (positionally changed) from the image forming position C to the movable position D as shown in FIG. 4.

With this displacement (movement) of the tray 35, the drum 1 of each cartridge P held by the tray 35 is spaced from the belt 13 as shown in FIG. 4. The movable position D is a spaced position where the drum 1 is spaced from the belt 13 in a state in which the tray 35 is positioned inside the apparatus main assembly 100A. The tray 35 is raised and lowered inside the apparatus main assembly 100A, so that the tray 35 moves between the image forming position C and the movable position D.

Simultaneously with the spacing (separation) between the drum 1 and the belt 13, interface members (e.g., an urging member, a drive connection member, an energizing member and the like for the cartridge) for each cartridge P are spaced from the cartridge P. An interrelating mechanism of the door 31 with the tray holding members 34L and 34R will be specifically described later. When the tray 35 is in the movable position D, the drum 1 and the belt 13 are not in contact with each other, and therefore the tray 35 can be moved to an outside (mounting and demounting position E) of the image forming apparatus.

2-2) Displacement of Tray between Movable Position D and Mounting and Demounting Position E As shown in FIGS. 3 and 4, a grip portion (movement limitation eliminating means) 35*a* provided on a tray frame piece exposed through the opening 30 which is open can be gripped. By gripping the grip portion 35*a* in a predetermined manner, an unshown projection preventing claw (movement limiting means) for the tray 35 is disengaged from a main assembly-side claw hooking portion (main assembly-side engaging portion).

Figure 5:
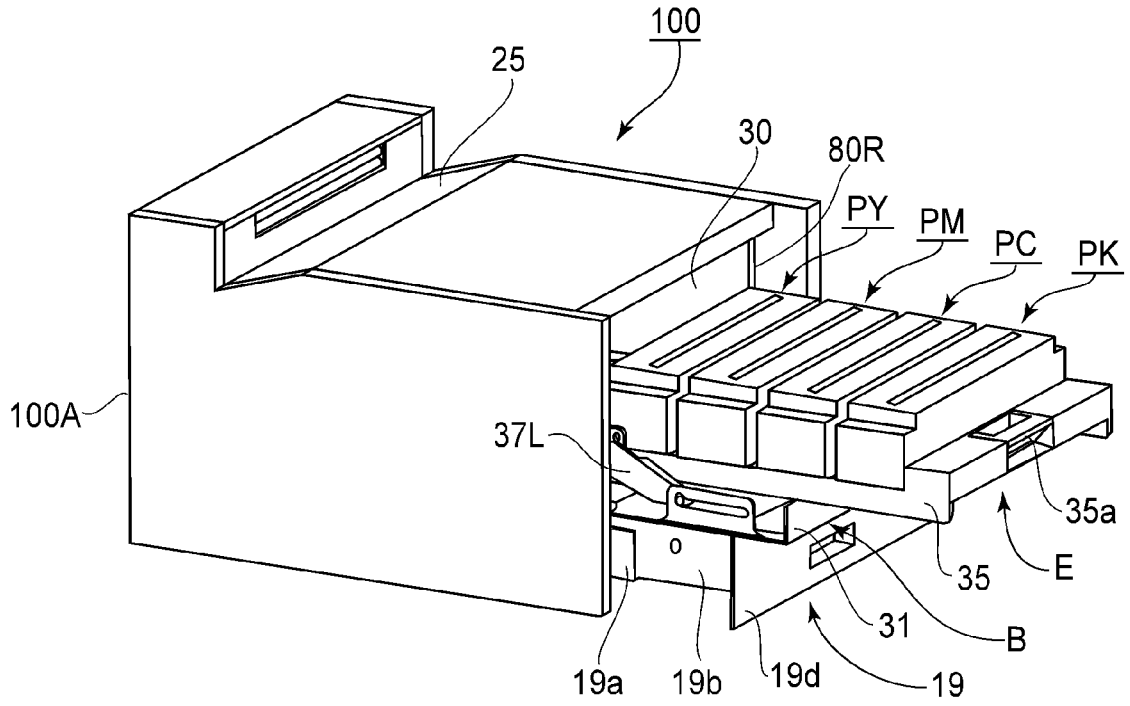
FIG. 5 is a perspective view of an outer appearance of the image forming apparatus in a state in which a tray is pulled out.
Figure 6:
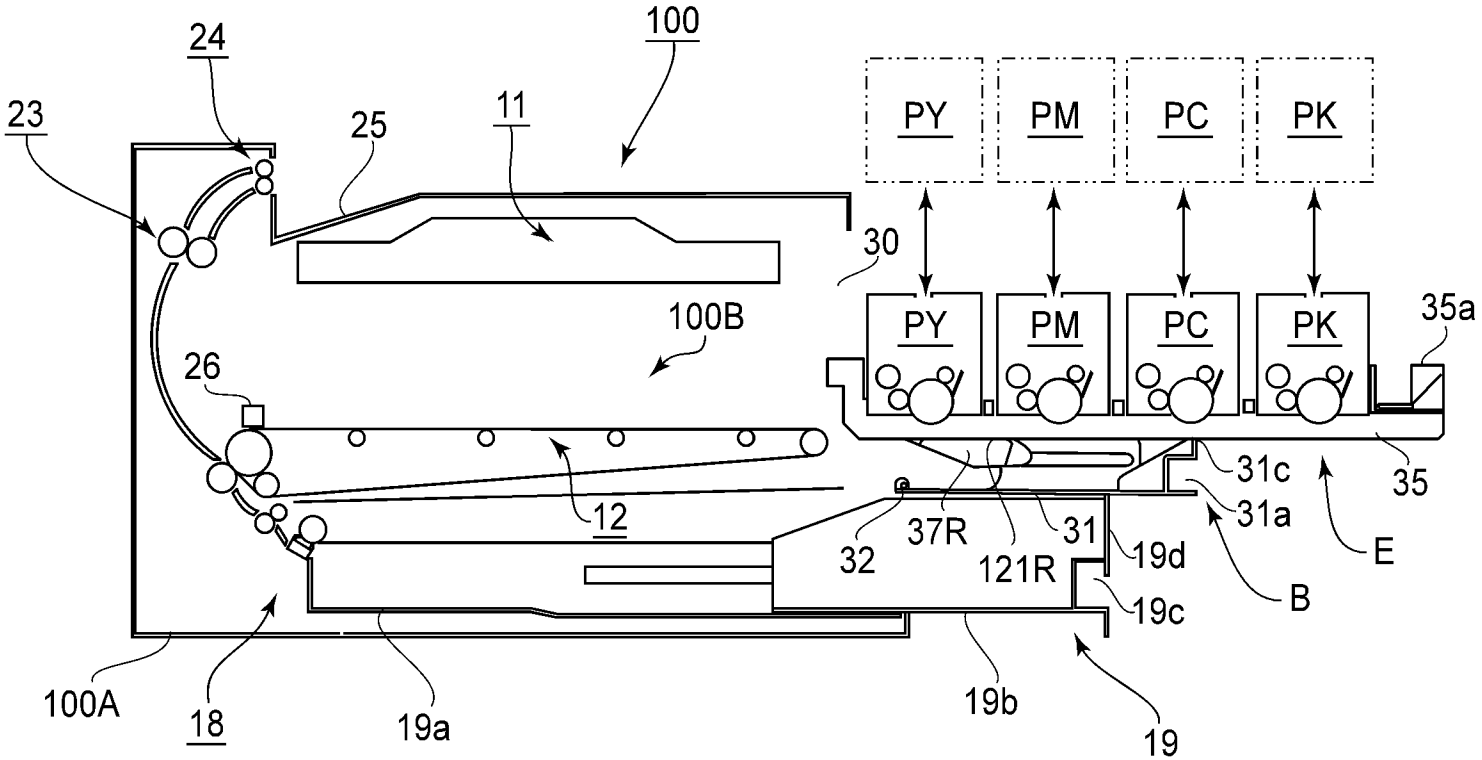
FIG. 6 is a longitudinal left side view of the image forming apparatus in the state in which the tray is pulled out.

Thus, the tray 35 can be pulled out from the movable position D inside the apparatus main assembly 100A to an outside of the apparatus main assembly 100A, so that the tray 35 slides relative to the tray holding members 34L and 34R and thus is slidable movable horizontally in the frontward direction. Therefore, as shown in FIGS. 5 and 6, the tray 35 can be placed in a state in which the tray 35 is projected to a predetermined pulling-out position, i.e., a mounting and demounting position, where each cartridge P can be mounted in and demounted from the tray 35 in a predetermined manner, outside the apparatus main assembly 100A.

As a result, the entire four (first to fourth) cartridge PY, PM, PC and PK held by the tray 35 pass through the opening 30 and are exposed to the outside of the apparatus main assembly 100A, so that upper (top) surfaces of all the cartridge P are exposed. When the tray 35 is pulled out from the movable position P by a sufficient predetermined amount, the tray 35 is prevented by an unshown stopper portion from being pulled out further. At this time, the tray 35 held by the tray holding members 34L and 34R is held by the portion 31 and the sheet feeding cassette 19 in a state in which the tray 35 is horizontally pulled out to the predetermined mounting and demounting position E, as described specifically later.

The tray 35 supports each cartridge P so as to be detachably movable toward right above (upward) at the mounting and demounting position E. Further, the tray 35 supports each cartridge P by moving each cartridge P toward right below (downward). As shown by a broken line in FIG. 6, a used-up cartridge P to be replaced is raised upward and removed. Then, a fresh cartridge P is engaged in and placed on the tray 35 from above. That is, when the tray 35 is pulled out to the outside of the apparatus main assembly 100A, each cartridge P can be mounted in and demounted from the apparatus main assembly 100A.

The tray 35 is the movable member provided movably in the direction (perpendicular direction) perpendicular (crossing) the axial direction (longitudinal direction of the cartridge P) of the drum 1 of each cartridge P placed on the tray 35. That is, a movement direction of the tray 35 between the movable position D and the mounting and demounting position E is the direction perpendicular to the longitudinal direction of the cartridge P. With respect to the movement direction between the movable position D and the mounting and demounting position E, the tray 35 is capable of mounting and juxtaposing thereon the plurality of cartridges P.

2-3) Image forming Position C, Movable Position D and Mounting and Demounting Position E of Tray In this way, the tray 35 for mounting thereon the cartridges P is movable to the image forming position (accommodated position) C, the movable position D and the mounting and demounting position E. The image forming position (accommodated position) C of the tray 35 is a position where the tray 35 is positioned inside the apparatus main assembly 100A and locates the cartridges P at the mounted position where the image forming operation can be performed (FIG. 2).

The movable position D of the tray 35 is in a halfway position of a moving path of the tray 35 from the mounting and demounting position E to the image forming position C, and is a position where the tray 35 is movable to the image forming position C in interrelation with movement of the main assembly door 31 from the open position B to the closed position B (FIG. 4). The mounting and demounting position E is a position where the tray 35 is projected to the outside of the apparatus main assembly 100A through the opening 30 so as to enable the mounting and demounting of the cartridges P (FIGS. 5 and 6).

The left and right tray holding members 34L and 34R are a moving means for moving the tray 35 in the obliquely upward direction from the image forming position C toward the movable position D before the tray 35 is moved to the mounting and demounting position (pulled-out position) E where the cartridges P are mountable and demountable. Reversely, the left and right tray holding members 34L and 34R are also a moving means for moving the tray 35 in the obliquely downward direction from the movable position D toward the image forming position C.

In other words, the tray holding members 34L and 34R are a supporting member for supporting the tray 35, and is movable between a first position for permitting movement of the tray 35 between the mounting and demounting position E and the movable position D and a second position for permitting positioning of the tray 35 in the image forming position C. In interrelation with the closing of the door 31 from the open position B to the closed position A, the tray holding members 34L and 34R are moved from the first position to the second position. Further, in interrelation with the opening of the door 31 from the closed position A to the open position B, the tray holding members 34L and 34R are moved from the second position to the first position.

2-4) Cartridge Exchange

With respect to specific cartridge exchange, as shown in FIGS. 5 and 6, the tray 35 is pulled out to the mounting and demounting position E, and then the cartridge, of the plurality of cartridges P held by the tray 35, to be replaced is exchanged. After the cartridge is exchanged, the tray 35 is accommodated inside the apparatus main assembly by being moved so as to be sufficiently pushed in a reverse direction, thus being returned to a state before the pulling out as shown in FIGS. 3 and 4. At this time, the tray 35 is urged from the rear side toward the front side by an unshown spring (urging means), so that an operation for sufficiently pushing the tray 35 back to a predetermined position by the user can be performed with reliability.

When the tray 35 is sufficiently pushed back to the predetermined position, the unshown projection preventing claw (movement limiting means) of the tray 35 engages with the main assembly-side claw hooking position (main assembly-side engaging portion). As a result, the tray 35 is pushed back from the mounting and demounting position E to the movable position D inside the apparatus main assembly, and then is positionally regulated at the position.

Then, the door 31 which is open is closed as shown in FIGS. 1 and 2, so that the image forming apparatus 100 is in an image formable state. That is, the tray holding members 34L and 34R are displaced (moved) in the obliquely downward direction (rearward direction and downward direction) in interrelation with the closing rotational movement of the door 31 from the open position B to the closed position A, so that the tray 35 is displaced (moved) from the movable position D to the image forming position C. As a result, the cartridges P supported by the tray 35 are in the associated mounted positions in the cartridge accommodating portion 100B inside the apparatus main assembly. At the same time, the interface members for each cartridge P contact the cartridge P.

2-5) Interrelating Mechanism of Door 31 with Tray Holding Members 34L and 34R The interrelating mechanism of the door 31 with the tray holding members 34L and 34R will be described with reference to FIG. 10. In FIG. 10, (a) and (b) are perspective views of the interrelating mechanism of the door 31 with the tray holding members 34L and 34R, and (b) of FIG. 10 is an enlarged view of (a) of FIG. 10 in the apparatus main assembly front side. Hinge portions 32L and 32R of the door 31 are horizontally and coaxially arranged in a left-right direction relative to the apparatus main assembly 100A, and left and right end portions thereof are rotatably shaft-supported and held between unshown bearing members provided in left and right sides of the apparatus main assembly 100A. The bearing members may also be the left and right frames 80L and 80R.

Further, in the neighborhood of the left and right end portions of the door 31, connecting arms 37L and 37R as a constituent element connect the apparatus main assembly 100A and the door 31. Hinge portions 38L and 38R of the connecting arms 37L and 37R are horizontally and coaxially arranged in a left-right direction relative to the apparatus main assembly 100A, and are rotatably held relative to unshown bearing members provided in left and right sides of the apparatus main assembly 100A. The bearing members may also be the left and right frames 80L and 80R. Outside the left frame 80L and the right frame 80R, a pair of left and right connecting rods 201L and 201R each extending in the front-rear direction as the longitudinal direction thereof is provided. Each of the connecting rods 201L and 201R is supported by an unshown guiding member provided in an associated left or right side of the apparatus main assembly so as to be movably only in the front-rear direction.

Each of the connecting arms 37L and 37R is provided with horizontal shafts 37*a* and 37*b*. The horizontal shaft 37*a* of the left connecting arm 37L is inserted in and engaged with a vertically elongated hole 201A provided in the front side of the left connecting rod 201L, and the horizontal shaft 37*b* of the left connecting arm 37L is inserted in and engaged with a groove 31B provided at a left side surface portion of the door 31. Further, The horizontal shaft 37*a* of the right connecting arm 37R is inserted in and engaged with a vertically elongated hole 201A provided in the front side of the right connecting rod 201R, and the horizontal shaft 37*b* of the right connecting arm 37R is inserted in and engaged with a groove 31B provided at a right side surface portion of the door 31.

Further, in FIG. 10, each of the left and right tray holding members 34L and 34R is provided with two pin shafts 34*c* and 34*d* with an interval therebetween in the front-rear direction, and each of the pin shafts 34*c* and 34*d* is engaged with a guiding hole 36 provided in the associated left or right frame 80L or 80R of the apparatus main assembly 100A. By engagement between the guiding hole 36 and each of the pin shafts 34*c* and 34*d*, the tray holding members 34L and 34R are supported by the left and right frames 80L and 80R, respectively. The pin shaft 34*c* of each of the left and right tray holding members 34L and 34R penetrates though the guiding hole 36 and then is inserted in and engaged with the vertically elongated hole 201B provided in each of the connecting rods 201L and 201R.

In this way, the door 31 and the tray holding members 34L and 34R are connected via the connecting arms 37L and 37R and the connecting rods 201L and 201R. As a result, when the door 31 is opened and closed, in interrelation with this opening and closing, a moving force for moving the tray 35 between the movable position D and the image forming position C acts on the left and right tray holding members 34L and 34R. At this time, the hinge portions 38L and 38R of the connecting arms 37L and 37R may also be disposed coaxially with the hinge portions 32L and 32R of the door 31. Further, without providing the connecting arms 37L and 37R, the door 31 and the connecting rods 201L and 201R may also be directly connected with each other.

Figure 12:
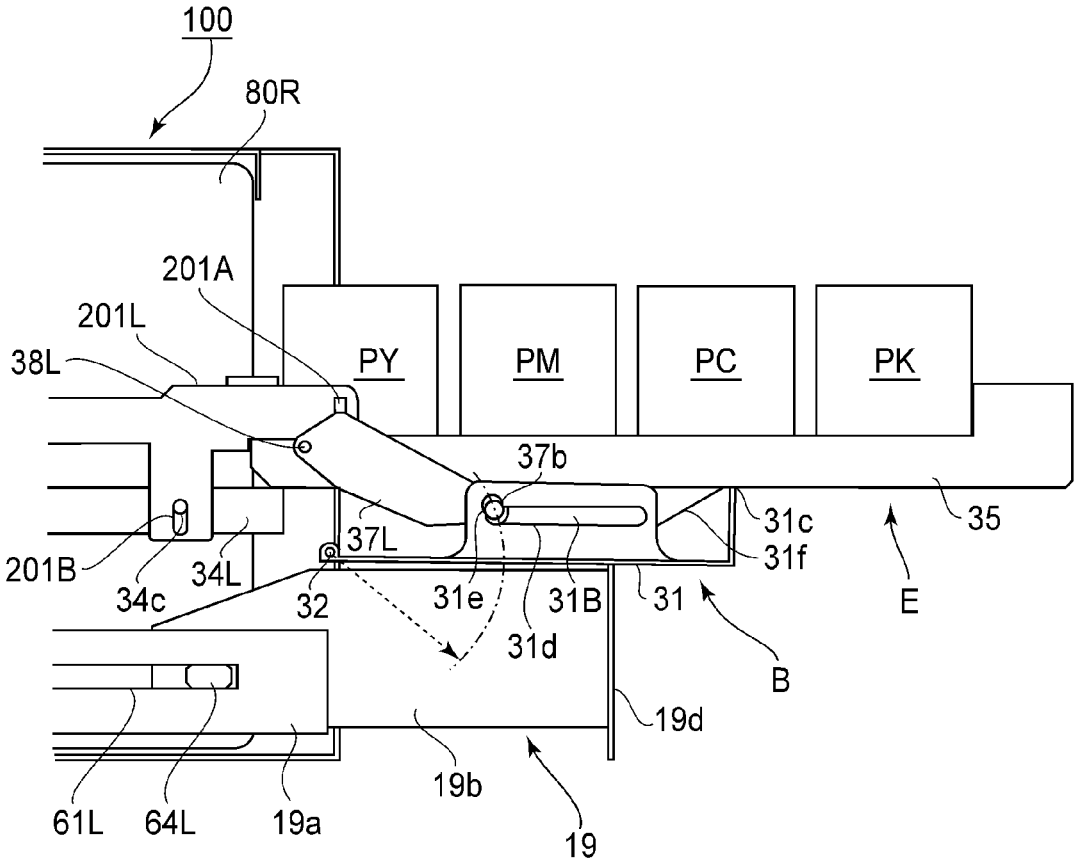
FIG. 12 is a left side view of the image forming apparatus in the First Embodiment in the state in which the tray is pulled out.

FIG. 12 is a side view, as seen from a left side, showing a state in which the tray 35 is pulled out to the mounting and demounting position E where the cartridges P are exchangeable. For explanation, the left-side cover and the left frame 80L are omitted from illustration. In FIG. 12, the groove 31B provided in the door 31 is connected by a rectilinear guiding portion 31*d* and a guiding portion 31*e* concentrically with the hinge shaft 32 of the door 31. As a result, the above-described interrelating mechanism of the door 31 with the tray holding member in the case where the door 31 is opened is operated by the groove 31B until the shaft 37*b* of the connecting arm 37 reaches a guiding portion 31*e* connecting concentric circles with the hinge shaft 32.

When the door 31 is opened by a certain angle or more and the shaft 37*b* of the connecting arm 37 reaches the guiding portion 31*e* connecting the concentric circles with the hinge shaft 32, the connecting arm 37 and the tray holding member 34 stop interrelation therebetween, and then only the door 31 is opened further. Then, when the door 31 is opened to an angle where the door 31 contacts the front plate 19*d* of the sheet feeding cassette 19, the tray 35 and the cartridges P can be reliably moved to the movable position D shown in FIGS. 3 and 4.

(Support of Tray 35 in Mounting and Demounting Position E)

Figure 11:
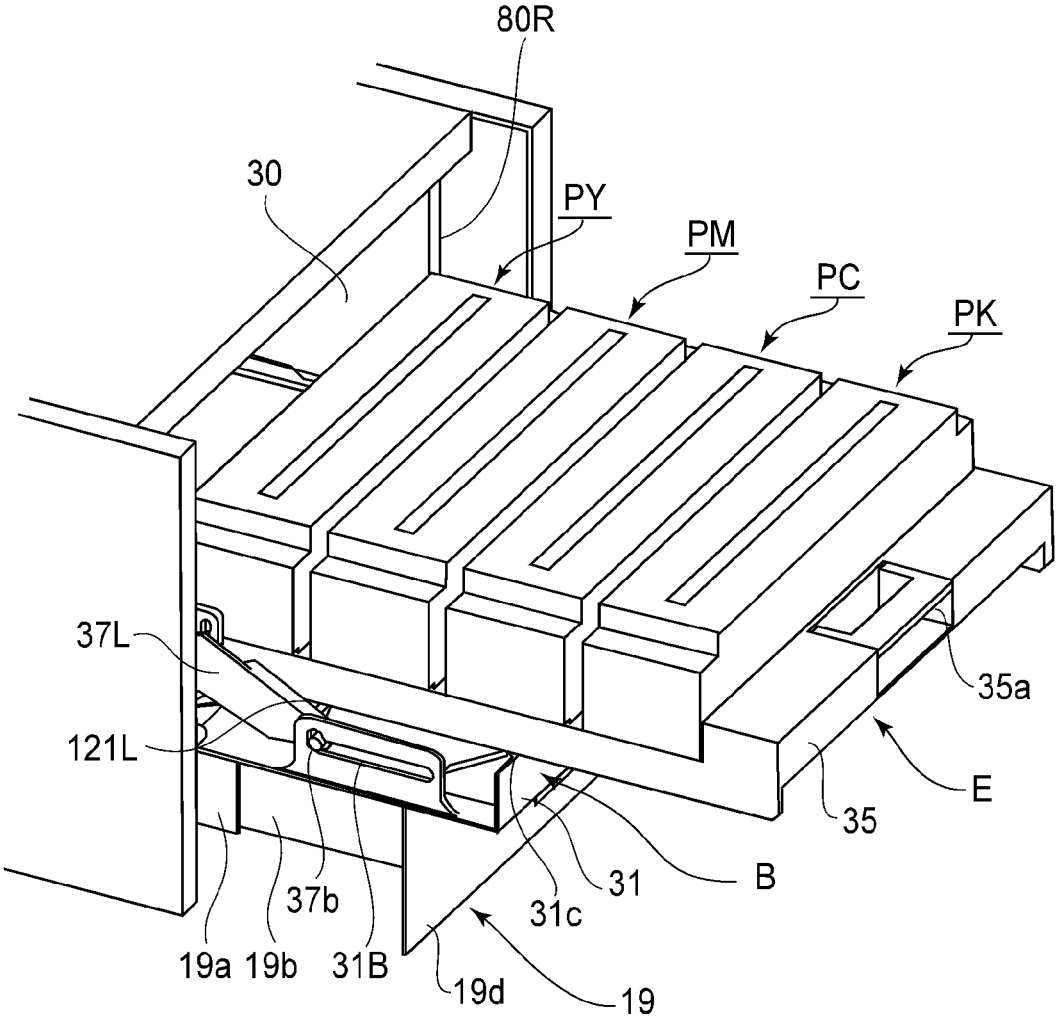
FIG. 11 is a perspective view of an outer appearance of the image forming apparatus in a front side in the state in which the tray is pulled out.

FIGS. 5 and 11 are perspective views and FIG. 6 is a sectional view, each showing a state in which the tray 35 is pulled out to the mounting and demounting position E where each cartridge P is exchangeable. In this case, the tray 35 in the position where the tray 35 is largely projected from the apparatus main assembly 100A is supported by a supporting arm 121L (third supporting arm) of the connecting arm 37L shown in FIG. 11, a supporting arm 121R (third supporting arm) of the connecting arm 37R, and a free end supporting arm 31*c* (second supporting arm) of the door 31.

In this case, as shown in FIGS. 11 and 12, the door 31 is supported by the front plate 19*d* of the sheet feeding cassette 19 as specifically described later. As a result, it is possible to prevent damage of the surface of the drum 1 caused by large downward flexure of the tray 35 by self-weight of the tray 35 and the cartridges P in the front side of the apparatus main assembly and to prevent the apparatus main assembly 101 from falling frontward due to out of weight balance caused by the pulling-out of the tray 35.

Shapes and the number of supporting points of the supporting arms 121L and 121R of the connecting arms 37L and 37R may also be different from those shown in FIGS. 5, 6 and 11. Further, a shape of the supporting arm 31*c*, provided on the door 31, for supporting the tray 35 and an amount of projection of the tray 35 from the supporting arm 31*c* may also be different from those shown in FIGS. 5, 6 and 11.

As shown in FIG. 12, the supporting arm 31*c*, provided on the door 31, for supporting the tray 35 is provided with an inclined surface portion 31*f* in an upstream side of the pulling-out direction of the tray 35. By using this inclined surface portion 31*f*, the user moves the tray 35 along the inclined surface portion 31*f* when the tray 35 is pulled out from the movable position D to the mounting and demounting position E, so that a free end side of the tray 35 can be placed on the supporting arm 31*c* with reliability. That is, the inclined surface portion 31*f* is a guiding portion for guiding the tray 35 to the supporting arm 31*c* (second supporting portion).

(Sheet Feeding Cassette 19)

1) Extension and Contraction of Sheet Feeding Cassette 19

Figure 7:
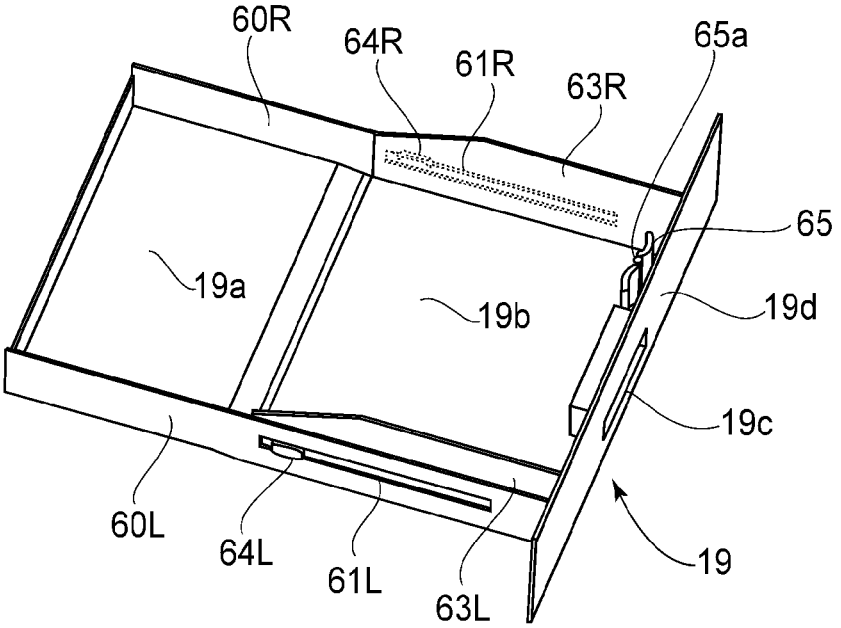
FIG. 7 is a perspective view of a sheet feeding cassette (accommodated position) in the First Embodiment.
Figure 8:
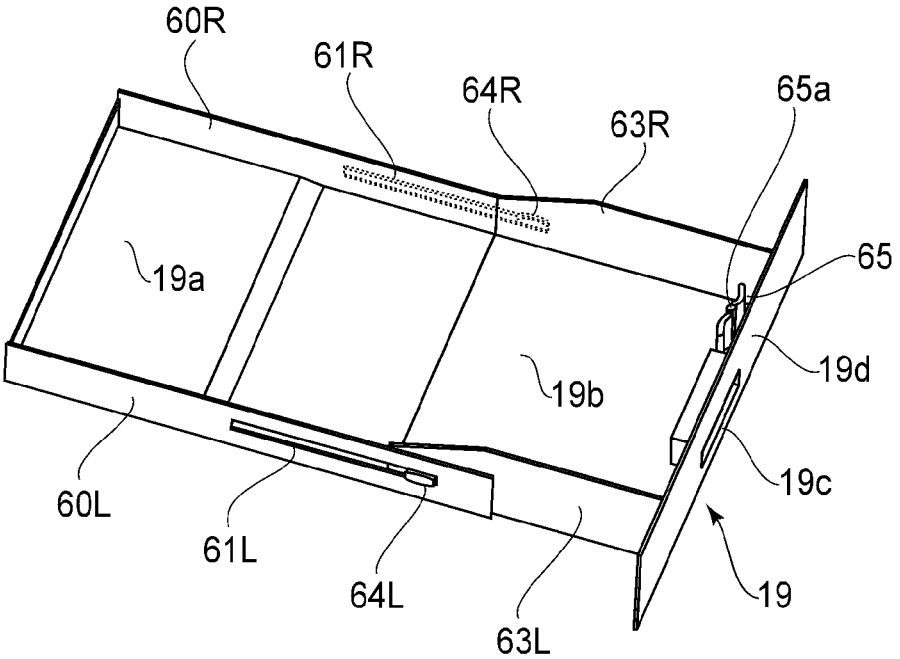
FIG. 8 is a perspective view of the sheet feeding cassette (using position) in the First Embodiment.

With respect to the sheet feeding cassette 19 which is a cassette, the sub-container 19*b* slides with the main container 19*a* and thus is extendable (expandable) and contractible (retractable) relative to the main container 19*a* (FIGS. 7 and 8). That is, as perspective views of the outer appearances of the sheet feeding cassette 19, FIG. 7 shows the state in which the sub-container 19*b* is in the accommodated position (first position), and FIG. 8 shows a state in which the sub-container 19*b* is in the using position (second position). For simplicity of explanation, mechanism parts such as a sheet regulation guiding part provided in the sheet feeding cassette 19 are not illustrated in the figures.

When the recording material S is placed in the sheet feeding cassette 19, as shown in FIG. 8, the sub-container 19*c* can be pulled out to the using position where the sub-container 19*b* is projected to the front side of the apparatus main assembly 100A. Further, when the image forming apparatus is not used, as shown in FIG. 7, the sub-container 19*b* can be accommodated in the accommodated position inside the apparatus main assembly 100A.

Left and right side walls 60L an 60R of the main container 19*a* are provided with extension and contraction guiding grooves 61L and 61R with which extension and contraction guiding projected portions 64L and 64R provided on left and right side walls 63L and 63R of the sub-container 19*b* are engaged, respectively. As a result, the sub-container 19*b* slides with the main container 19*a* in the front-rear direction of the apparatus main assembly, thus being extendable and contractible relative to the main container 19*a*.

When the tray 35 is horizontally pulled out to the mounting and demounting position E, the door 31 supports the tray 35 and the sheet feeding cassette 19 which is the cassette supports the door 31, whereby the tray 35 is held by the door 31 and the sheet feeding cassette 19. At this time, the position where the sheet feeding cassette 19 is pulled out is the same position as the using position where the sheet feeding cassette 19 is pulled out during mounting of the recording material S. However, the position where the pulled-out sheet feeding cassette 19 supports the door 31 may also be a position different from the using position where the sheet feeding cassette 19 is pulled out during mounting of the recording material S.

However, from the viewpoint that the sheet feeding cassette 19 supports the weight of the door 31 and the tray 35, it is preferable that the position of the supporting arm for supporting the door 31 is in the downstream side of the pulling-out direction of the tray 35.

The using position of the sub-container 19*b* (first supporting arm) is located downstream of the accommodated position with respect to the pulling-out direction of the tray 35. Conversely, the accommodated position is located upstream of the using position. Further, the supporting arm for supporting the door 31 is the front plate 19*d* of the sub-container 19*b*. That is, the front plate 19*d* of the sub-container 19*b* is used for supporting the door 31 at the using position where the sheet feeding cassette 19 is pulled out further from the accommodated position. For that reason, the front plate 19*d* of the sub-container 19*b* can stably support the weight of the door 31 and the tray 35. The sub-container 19*b* in the using position is constituted so as to support the weight of the door 31 and the tray 35 by being supported by the bottom of the main container 19*a* and the extension and contraction guiding grooves 61L and 61R. However, when the sub-container 19*b* in the using position supports the weight of the door 31 and the tray 35, at least a part of the sub-container 19*b* may also be constituted so as to be supported by the disposing surface where the image forming apparatus is disposed.

The sheet feeding cassette 19 can maintain a state in which the sub-container 19*b* is accommodated in the accommodated position when the image is not formed (when the recording material S is not accommodated in the sheet feeding cassette 19, i.e., during non-image formation). That is, the sheet feeding cassette 19 can maintain a state in which the sheet feeding cassette 19 is not projected (protruded) from the image forming main assembly. As a result, when the image forming apparatus is transported, a size of a packing for transportation can be reduced. Further, when the image is not formed, the sub-container 19*b* is accommodated in the accommodated position, so that a disposing area of the image forming apparatus can be reduced.

In this embodiment, a constitution in which the sub-container 19*b* was in the using position when the recording material S was accommodated in the sheet feeding cassette 19 was employed. However, the sub-container 19*b* is not always required to be in the using position during the image formation. For example, in the case where the recording material S is small, also a constitution in which the recording material S can be accommodated in the sheet feeding cassette 19 even when the sub-container 19*b* is in the accommodated position would be considered.

For example, when the recording material S has a relatively small size (first size, small size) such as a letter size or an A4 size, even in a state in which the sub-container 19*b* is in the accommodated position, the recording material S is made accommodatable in the sheet feeding cassette 19. On the other hand, a constitution in which the sub-container 19*b* is placed in the using position only when the size of the recording material S is a large size (second size, large side), such as a legal size, compared with the letter size and the A4 size, and then the recording material S is accommodated in the sheet feeding cassette 19 would be considered. That is, in the constitution, the size of the recording material S accommodatable in the sheet feeding cassette 19 is increased by moving the sub-container 19*b* from the accommodated position to the using position.

In this case, e.g., the following constitution can also be employed. That is, an interrelating mechanism for moving the sub-container 19*b* from the accommodated position to the using position in interrelation with the opening operation of the door 31 is provided in the image forming apparatus. As a result, independently of the size of the recording material S, when the sub-container 19*b* supports the door 31, the sub-container 19*b* can be moved to the using position (position where the sub-container 31 easily supports the door 31) by the interrelating mechanism.

2) Lock and Lock Release of Sheet Feeding Cassette 19 at Extension and Contraction Position With respect to the sheet feeding cassette 19, as shown in FIGS. 7 and 8, the sub-container 19*b* is provided with an extension and contraction control (operating) lever 65 rotatably about a supporting point 65*a* by a predetermined angle. Further, the extension and contraction control lever 65 interrelates with an unshown extension and contraction lock mechanism, and by the lock mechanism, the sliding movement of the sub-container 19*b* relative to the main container 19*a* is limited at the accommodated position and the using position.

That is, in the case where the user does not operate the extension and contraction controller 65, the sub-container 19*b* is fixed (locked) to the main container 19*a* at the accommodated position and the using position. Further, only in the case where the user operates the control lever 65, the sub-container 19*b* slides with the main container 19*a*, thus being extendable and contractible relative to the main container 19*a* (lock-released).

Second Embodiment

Figure 13:
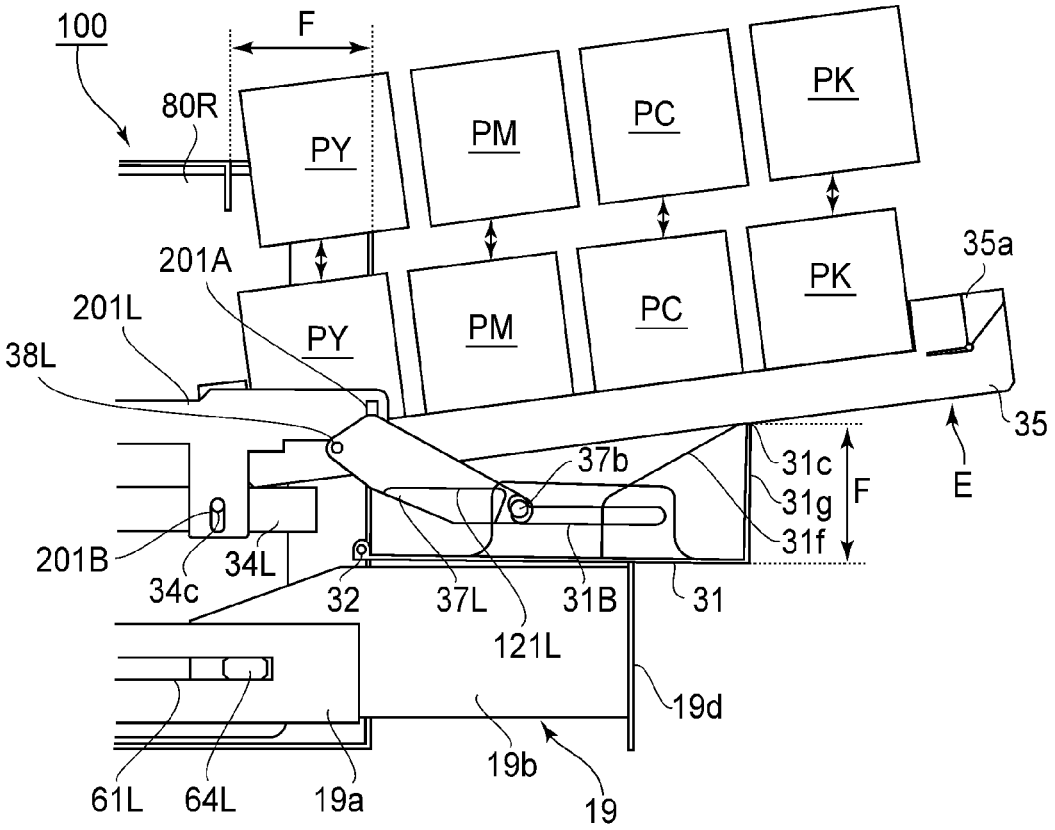
FIG. 13 is a left side view of an image forming apparatus in a Second Embodiment in a state in which a tray is pulled out.

FIG. 13 is a side view, as seen from the left side, showing a state in which a tray 35 is pulled out to a mounting and demounting position E where cartridges P are exchangeable in this embodiment. For explanation, a main assembly left-side cover and a left frame 80L are not illustrated.

A difference between the First Embodiment is that a length dimension F (FIG. 13) of an upper plate 31*g* of a door 31 is increased and that a height position 31*c* in FIG. 13 is made higher than the height position 31*c* in FIG. 6. As a result, when the user pulls out the tray 35 from a movable position D to the mounting and demounting position E, a free end of the tray 35 moves in a raising direction. That is, the tray 35 is supported by the supporting portion 31*c* (second supporting portion) at the free end of the door 31, which is open, so as to be inclined with respect to a direction (horizontal direction) connecting the movable position, spaced from the image forming position C, with the mounting and demounting position E.

In First Embodiment, the pulling-out operation of the tray 35 from the movable position D to the mounting and demounting position E is the linear motion (horizontal motion), whereas in this embodiment, the pulling-out operation is non-linear motion (non-horizontal motion).

Also in this embodiment, an inclined surface portion 31*f* is provided upstream of the tray supporting portion 31*c* provided on the front door, so that when the user grips and pulls the grip portion 35*a* of the tray 35 in the horizontal direction, the front side of the tray 35 is guided along the inclined surface portion 31*f* of the door 31. Then, the user can pull out the tray 35 to a position where the tray 35 is supported by the tray supporting portion 31*c*. That is, the tray 35 can be pulled out without causing the user to be aware of the non-linear motion.

In this embodiment, by increasing the dimension F of the upper plate 31*g* of the door 31, the apparatus main assembly upper surface portion can be further widely opened during opening of the door 31. As a result, compared with the First Embodiment, even in the case where a pulling out amount of the tray 35 is suppressed to a small value, it is possible to exchange the cartridge PY disposed at the rearmost position of the apparatus main assembly.

That is, when the tray 35 is pulled out to the mounting and demounting position E, an amount of projection of the front side of the tray 35 from the tray supporting portion 31*c* can be reduced. As a result, the weight of the tray 35 and the cartridges P in the mounting and demounting position E can be supported more stably by the door 31 and the sheet feeding cassette 19, and therefore the tray 35 and the connecting arm 37 can be further downsized.

Third Embodiment

Figure 15:
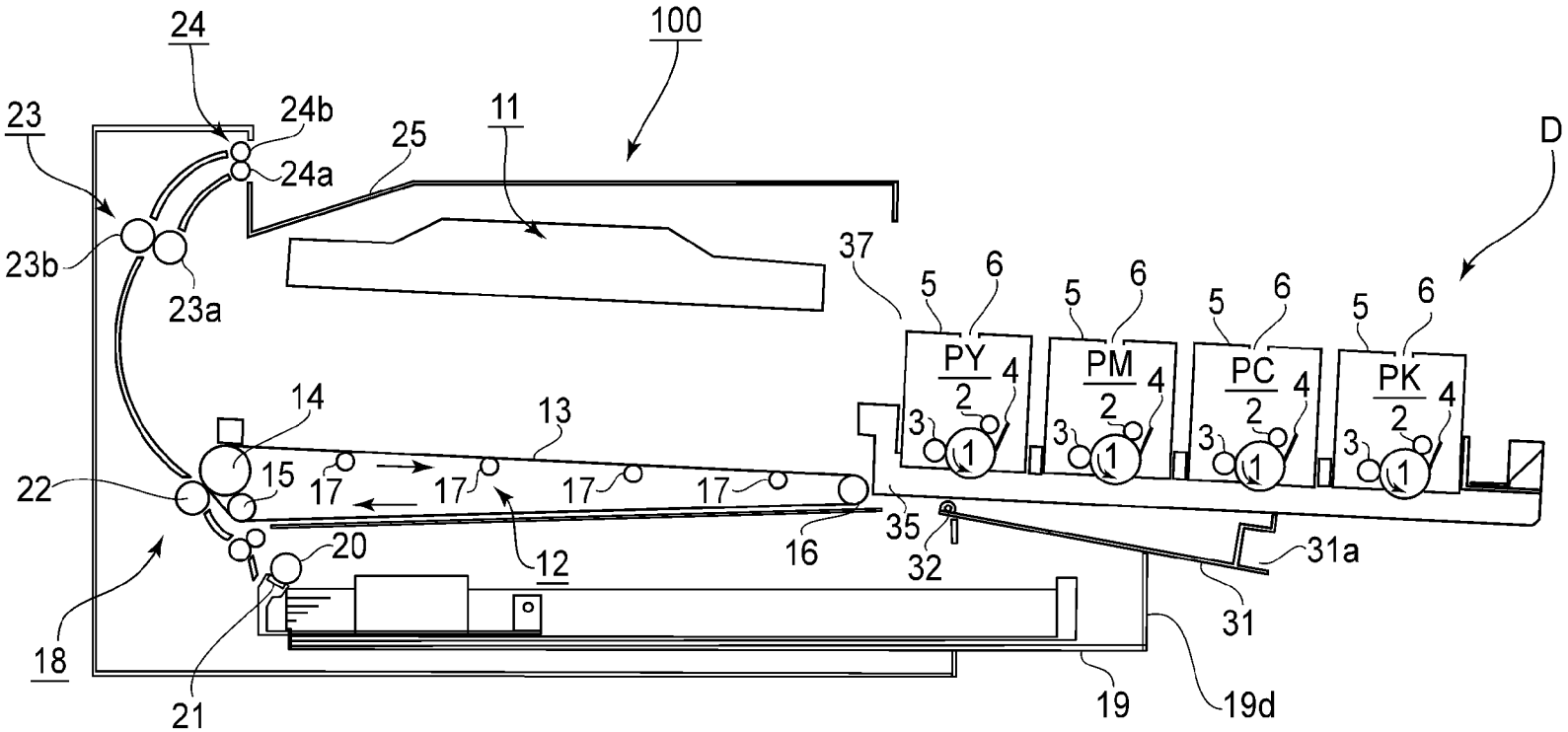
FIG. 15 is an illustration of the tray in a Third Embodiment.

A constitution of this embodiment is shown in FIG. 15. In the above-described embodiments, the constitution in which the tray 35 was moved to the mounting and demounting position E along the horizontal direction was employed. However, in this embodiment, the movement direction of the tray 35 is inclined with respect to the horizontal direction. When the tray 35 is moved from the inside to the outside of the image forming apparatus, i.e., when the tray 35 is moved from the movable position to the mounting and demounting position, the tray 35 moves obliquely downward.

For that reason, when the tray 35 is pulled out to the outside (mounting and demounting position) of the image forming apparatus, the tray 35 is disposed in an inclined state. With respect to the pulling out direction, a downstream side (right side of the tray in FIG. 15) of the tray 35 is positioned below an upstream side (left side of the tray in FIG. 15) of the tray 35.

When the tray 35 is disposed in an inclined state, there is a possibility that the tray 35 becomes unstable. For that reason, in the case where the tray 35 is inclined, as in this embodiment, support of the tray 35 by the sheet feeding cassette 19 is particularly effective.

As shown in FIG. 15, the tray 35 in the mounting and demounting position is contacted to the main assembly door 31 and is supported by the main assembly door 31. Further, the tray is contacted to a front plate 19*d* of the sheet feeding cassette 19 and is supported by the front plate 19*d* of the sheet feeding cassette 19. That is, the front plat 19*d* of the sheet feeding cassette supports the weight of the tray 35 via the main assembly door 31.

Modified Embodiments

In the above-described embodiments, preferred embodiments of the present invention were described, but the present invention is not limited to three embodiments. The present invention can be variously modified within the scope thereof.

Modified Embodiment 1

In the above described embodiments, the constitution in which the door 31 was supported by the front plate 19*d* of the sheet feeding cassette 19 in the using position was described. However, a positional relation between the door 31 and the sheet feeding cassette 19 is not limited thereto. For example, a constitution in which when the position of the front plate 19*d* of the sheet feeding cassette 19 in the using position is projected from the free end position of the door 31 during the opening toward the front side of the apparatus main assembly, the opened door 31 may also be supported by the left and right side walls 63L and 63R of the sub container 19*b* of the sheet feeding cassette 19 may also be employed. Further, a constitution in which a cover for protecting the sheets is provided at the upper surface of the sheet feeding cassette 19, and the opened door 31 is supported by the cover may also be employed.

Modified Embodiment 2

In the above-described embodiments, the constitution in which the sheet feeding cassette insertable in and demountable from the apparatus main assembly was extendable and contractible and in which the first supporting portion (the front plate 19*d* of the sub-container 19*b*) for supporting the door 31 was movable between the two positions consisting of the accommodated position and the using position was described. However, the present invention is not limited thereto, but a constitution in which the sheet feeding cassette 19 has such a size that the sheet feeding cassette 19 is projected from the hinge portion 32 of the door 31 toward the front side of the apparatus main assembly and in which there is no extension and contraction mechanism may also be employed. Further, a constitution in which the sheet feeding cassette 19 is not insertable into and demountable from the apparatus main assembly and is fixed to the apparatus main assembly may also be employed.

Modified Embodiment 3

In the above-described embodiments, the tray 35 moving linearly in the horizontal direction relative to the disposing surface of the apparatus main assembly 100A was described. That is, rectilinear displacement of the tray 35 between the mounting and demounting position E and the movable position (spaced position) D was described. However, the tray (cartridge supporting member) 35 is not limited thereto.

For example, a constitution in which between the mounting and demounting position E and the movable position (spaced position) D, the tray 35 is non-linearly displaced may also be employed. Alternatively, as the tray 35, the tray 35 may also be linearly movable in the direction crossing with the longitudinal direction of the drum 1 and in an obliquely upward direction or an obliquely downward direction, not the horizontal direction, relative to the disposing surface of the apparatus main assembly 100A. Further, a constitution in which the tray 35 can be demounted from the apparatus main assembly 100A by releasing a stopper may also be employed.

Modified Embodiment 4

The cartridge P is not limited to the integral-type process cartridge including the image bearing member 1 on which the latent image is formed and the developing means 3 for developing the latent image, formed on the image bearing member 1, with the developer. The cartridge P may also be a (function) separation-type process cartridge including the image bearing member 1 on which the latent image is formed and an image forming process means other than the developing means for developing the latent image, formed on the image bearing member 1, with the developer.

Further, the cartridge P may also be a developing cartridge including the developing means for developing the latent image, formed on the image bearing member 1, with the developer and the developer accommodating portion accommodating the developer used for developing the latent image.

Further, a constitution in which the cartridge supported by the tray 35 is a pair (combination) of the separation type process cartridge and the developing cartridge and in which at least one of the process cartridge and the developing cartridge is detachably mounted on the tray 35 may also be employed. In addition, the cartridge may also include a unit contributing to the image forming process for forming the image on the recording material by being detachably mounted to the apparatus main assembly.

Modified Embodiment 5

In the above-described embodiments, as the image forming apparatus, the full-color electrophotographic image forming apparatus to which the four cartridges accommodating the developers different in color were detachably mountable was described as an example. However, the number of the cartridges mounted in the image forming apparatus is not limited to four, but may also be appropriately set. The number of the cartridges P may also be one, two, three or five or more. Further, the present invention is also applicable to a single-color image forming apparatus including a single cartridge.

Modified Embodiment 6

In the image forming apparatus 100 in the above-described embodiments, the intermediary transfer unit 12 can also be changed to a recording material feeding transfer belt device for feeding the recording material S while holding the recording material S. That is, the intermediary transfer unit 12 can also be changed to the recording material feeding transfer belt device (recording material feeding transfer means) including a recording material feeding member for feeding the recording material S in order to directly transfer the developer image, formed on the drum 1, onto the recording material S.

An effect of the above-described embodiments is summarized as follows. That is, according to the constitutions described in the above-described embodiments, without enhancing rigidity of the tray leading to upsizing of the apparatus main assembly, the self-weight of the tray and the cartridge which are in the position projected from the apparatus main assembly can be simply supported.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Applications Nos. 2014-100398 filed on May 14, 2014 and 2015-082319 filed on Apr. 14, 2015, which are hereby incorporated by reference herein in their entirety.

What is claimed is:

1. An image forming apparatus comprising:

a main assembly provided with an opening;

a tray for placing thereon a cartridge for forming an image, wherein said tray is movable through the opening between an image forming position where the cartridge is used for image formation inside said main assembly and a mounting and demounting position where the cartridge is exposed to an outside of said main assembly and is mountable and demountable, wherein a pulling-out direction is a direction in which said tray is moved from inside of said main assembly to the mounting and demounting position;

a door for opening and closing the opening; and an accommodating member for accommodating a sheet on which an image is formed, said accommodating member comprising a first member and a second member including a door supporting portion for supporting said door, wherein said second member is movable relative to said first member between a first position and a second position downstream of the first position with respect to the pulling-out direction, and wherein when said second member is in the second position and said tray is in the mounting and demounting position, said second member supports said door, which supports said tray.

2. An image forming apparatus according to claim 1, wherein said accommodating member is capable of accommodating a sheet having a first size and a sheet having a second size larger than the first size, wherein said second member is in the first position when said accommodating member accommodates the recording material having the first size, and wherein said second member is in the second position when said accommodating member accommodates the recording material having the second size.

3. An image forming apparatus according to claim 1, further comprising a connecting arm for connecting said main assembly and said door, wherein said tray is also supported by said connecting arm in addition to said door.

4. An image forming apparatus according to claim 1, wherein said tray is supported by another supporting portion provided at a free end of said door.

5. An image forming apparatus according to claim 1, wherein said door includes another supporting portion for supporting said tray and an inclined surface portion positioned upstream of said another supporting portion with respect to a pulling-out direction in which said tray is moved from an inside of said main assembly to the mounting and demounting position, and wherein said inclined surface portion guides said tray, moving toward the mounting and demounting position, to said another supporting portion.

6. An image forming apparatus according to claim 1, further comprising a belt member circulating inside said main assembly, wherein the cartridge includes an image bearing member on which a latent image is formed, wherein when said tray is in the image forming position, the image bearing member contacts said belt member, and wherein said tray is movable to a spaced position, where the image bearing member is spaced from said belt member, inside said main assembly and between the image forming position and the mounting and demounting position.

7. An image forming apparatus according to claim 6, wherein the pulling-out direction is a direction obliquely inclined downwardly with respect to a horizontal direction.

8. An image forming apparatus according to claim 6, wherein when said door is displaced between a closed position and an open position, said tray is displaced between the image forming position and the spaced position in interrelation with opening and closing of said door.

9. An image forming apparatus according to claim 6, wherein displacement of said tray between the spaced position and the mounting and demounting position is not interrelated with opening and closing of said door.

10. An image forming apparatus according to claim 6, wherein said tray is linearly displaced between the mounting and demounting position and the spaced position.

11. An image forming apparatus according to claim 6, wherein said tray is non-linearly displaced between the mounting and demounting position and the spaced position.

12. An image forming apparatus according to claim 1, wherein said tray supports the cartridge demountably upward at the mounting and demounting position.

13. An image forming apparatus according to claim 1, wherein when said tray is in the mounting and demounting position, a downstream side of said tray with respect to a pulling-out direction is positioned below an upstream side of said tray with respect to the pulling-out direction.

14. An image forming apparatus according to claim 1, wherein said door is movable between a closed position where the opening is closed and an open position where the opening is open, wherein said accommodating member is positioned below said door when said door is in the open position.

15. An image forming apparatus according to claim 1, wherein said accommodating member is disposed below said tray positioned in the image forming position.

16. An image forming apparatus comprising:

a main assembly provided with an opening;

a tray for placing thereon a cartridge for forming an image, wherein said tray is movable through the opening between an inside position where the cartridge is inside said main assembly and an outside position where the cartridge is exposed to an outside of said main assembly and is mountable and demountable, wherein a pulling-out direction is a direction in which said tray is moved from inside of said main assembly to the outside position;

a door for opening and closing the opening; and an accommodating member for accommodating a sheet on which an image is formed, said accommodating member comprising a first member and a second member including a door supporting portion for supporting said door, wherein said second member is movable relative to said first member between a first position and a second position downstream of the first position with respect to the pulling-out direction, and wherein when said second member is in the second position and said door opens the opening and said tray is in the inside position, said second member supports said door.

17. An image forming apparatus according to claim 16, wherein said accommodating member is capable of accommodating a sheet having a first size and a sheet having a second size larger than the first size, wherein said second member is in the first position when said accommodating member accommodates the recording material having the first size, and wherein said second member is in the second position when said accommodating member accommodates the recording material having the second size.

18. An image forming apparatus according to claim 16, wherein the pulling-out direction is a direction obliquely inclined downwardly with respect to a horizontal direction.

19. An image forming apparatus according to claim 16, wherein said door is movable between a closed position where the opening is closed and an open position where the opening is open, wherein said accommodating member is positioned below said door when said door is in the open position.

20. An image forming apparatus according to claim 1, wherein said accommodating member is disposed below said tray positioned in the inside position.

* * * * *